United States Patent [19]

Agrawal et al.

[11] Patent Number: 5,063,746

[45] Date of Patent: Nov. 12, 1991

[54] CRYOGENIC PROCESS FOR THE PRODUCTION OF METHANE-FREE, KRYPTON/XENON PRODUCT

[75] Inventors: Rakesh Agrawal, Allentown; Brian E. Farrell, Fogelsville, both of Pa.

[73] Assignee: Air Products and Chemicals, Inc., Allentown, Pa.

[21] Appl. No.: 650,523

[22] Filed: Feb. 5, 1991

[51] Int. Cl.[5] ..... F25J 3/04

[52] U.S. Cl. ..... 62/22; 55/66; 423/262

[58] Field of Search ..... 62/20, 22; 55/66; 423/262

[56] References Cited

U.S. PATENT DOCUMENTS

| | | | |
|---|---|---|---|
| 3,596,471 | 8/1971 | Streich | 62/22 |
| 3,751,934 | 8/1973 | Frischbier | 62/22 |
| 4,384,876 | 5/1983 | Mori et al. | 62/22 |
| 4,401,448 | 8/1983 | LaClair | 62/22 |
| 4,421,536 | 12/1983 | Mori et al. | 62/22 |
| 4,647,299 | 3/1987 | Cheung | 62/22 |

*Primary Examiner*—Ronald C. Capossela

*Attorney, Agent, or Firm*—Willard Jones, II; William F. Marsh; James C. Simmons

[57] ABSTRACT

The present invention relates to a process for the production of kryton and xenon by using a vapor stream containing greater than 2% oxygen to strip a liquid stream containing oxygen, krypton, methane and xenon of methane. This is accomplished by properly adjusting the liquid to vapor flows in the distillation column. The use of a suitable reflux liquid will decrease the loss of krypton and xenon in the methane laden vapor stream leaving the distillation system.

3 Claims, 4 Drawing Sheets

CRYOGENIC PROCESS FOR THE PRODUCTION OF METHANE-FREE, KRYPTON/XENON PRODUCT

TECHNICAL FIELD

The present invention is related to a cryogenic distillation process to produce xenon and krypton from air.

BACKGROUND OF THE INVENTION

Krypton and xenon are present in air as trace components (1.14 ppm and 0.086 ppm, respectively}and can be produced in pure form from the cryogenic distillation of air. Both of these elements are less volatile (higher boiling) than oxygen and therefore concentrate in the liquid oxygen sump in the low pressure column in a conventional double column air separation unit. Impurities that are less volatile than oxygen, such as methane, will also concentrate in the liquid oxygen sump along with krypton and xenon. Unfortunately, process streams containing oxygen, methane, krypton and xenon present a safety problem due to the combined presence of methane and oxygen.

Methane and oxygen form flammable mixtures with a lower flammability limit of 5% methane in oxygen. In order to operate safely, the methane concentration in an oxygen stream must not be allowed to reach the lower flammability limit and, in practice, a maximum allowable methane concentration is set that is a fraction of the lower flammability limit. This maximum effectively limits the concentration of the krypton and xenon that are attainable as any further concentration of these products would also result in a methane concentration exceeding the maximum allowed. Therefore, it is desirable to remove methane from the process.

Methane is currently removed from the krypton and xenon concentrate stream using a burner that operates at 800–°1000° F. The burning of methane produces two undesirable by-products, water and carbon dioxide, in the process stream. These impurities are typically removed by molecular adsorption. Therefore, the current method of removing methane requires a methane burner, an adsorption system, and several heat exchangers to warm the stream from a cryogenic temperature to the burner temperature and then back to a cryogenic temperature after the adsorption step. Methane removal in this manner also results in some loss of krypton and xenon.

Numerous processes are taught in the background art, among these are the following:

U.S. Pat. No. 4,647,299 discloses a process that concentrates krypton and xenon in a liquid product stream from a feed containing oxygen, krypton, xenon, and methane. The objective of this process is to alleviate the safety concerns associated with streams containing oxygen and methane by removing oxygen. Oxygen removal is accomplished in a single distillation column. In the oxygen removal, a feed liquid, containing oxygen, krypton, xenon, and methane is fed into a distillation column at an intermediate point as shown in FIG. 1. A vapor stream, containing less than 2% oxygen, is introduced to said column at a point below said intermediate point. A liquid, containing less than 3 ppm krypton and less than 0.2 ppm xenon is introduced above said intermediate point to provide reflux. Additional vapor is provided by reboiling downflowing liquids in a reboiler located at the bottom of said column. A liquid product stream, concentrated in krypton and xenon and substantially oxygen-free is withdrawn from the bottom of said column.

In the example presented in U.S. Pat. No. 4,647,299 the vapor feed to the bottom of the column was gaseous nitrogen and the reflux liquid fed to the top of the column was liquid nitrogen. The gaseous nitrogen introduced below the feed point strips downflowing liquid of oxygen such that liquid product withdrawn from the bottom of the column contains 0.8% oxygen and 97.1 nitrogen. The concentration of krypton and xenon increased from 443 ppm and 38 ppm, respectively, in the feed, to 15000 ppm krypton and 2000 ppm xenon in the liquid product stream. However, the hydrocarbon concentration of about 4000 ppm in the liquid product stream was the same as in the intermediate feed stream. The process described in U.S. Pat. No. 4,647,299 alleviates the problems involved with methane/oxygen mixtures by removing oxygen from the process. Most of the hydrocarbons are not removed in this cryogenic distillation and must be removed by further processing of the liquid product stream.

Another process that addressed the safety concerns {associated with oxygen-methane mixtures) in the production of krypton and xenon was disclosed in U.S. Pat. No. 3,596,471. In this process, liquid oxygen withdrawn from the low pressure column sump is fed to an adsorber that removes hydrocarbons, with the exception of methane, and then to the top of an oxygen stripping column. Vapor in the column is provided by a gaseous argon stream fed at the bottom of the column. The rising vapor strips the descending liquid of oxygen and is recycled to the argon column. Liquid product withdrawn from the sump of the oxygen stripping column contains oxygen, krypton, xenon and methane in argon. Introduction of argon into the bottom of the oxygen stripping column effectively displaces oxygen such that the product stream does not contain enough oxygen to form a flammable mixture with methane. However, methane and residual oxygen in the product stream must be removed prior to obtaining pure krypton and xenon. Methane is removed in a methane burner and residual oxygen is removed in a second distillation column. The patent also discloses a process illustrated in East German Patent 39707 in which oxygen is stripped with gaseous nitrogen (instead of argon). The patent teaches that "due to equilibrium conditions, the replacement of oxygen by nitrogen remains incomplete, and the result is poor rectification in the stripping column."

U.S. Pat. No. 3,596,471 also discusses two West German patents 1,099,564 and 1,122,561 where attempts were made to remove methane rather than oxygen. The processes of these patents used extensive vaporization of liquid oxygen due to the dilution of the hydrocarbons by adsorption, however, methane cannot be entirely eliminated by this method.

Another process that produces a stream concentrated in krypton and xenon by cryogenic methods is disclosed in U.S. Pat. No. 4,401,448. The process uses two columns to concentrate krypton and xenon in addition to the standard double column ASU. In this process, a gaseous oxygen (gaseous oxygen) stream is withdrawn from below the first tray of the low pressure column and fed below the first tray of the rare gas stripping column. Reflux for this column is provided by a liquid oxygen stream withdrawn from the low pressure column at a point above where the gaseous oxygen stream was taken. Boilup in the rare gas stripping column is provided by indirect heat exchange with a gaseous nitrogen stream from the HP column. Vapor exiting from the top of the rare gas stripping column operates at a reflux ratio of 0.1 to 0.3 (preferred value 0.2). Liquid that is concentrated in krypton, xenon and hydrocarbons is withdrawn from the bottom of rare gas stripping column is fed to the top of the oxygen exchange column. A gaseous nitrogen stream, taken from the HP column, is introduced below the first stage of the oxygen exchange column such that the reflux ratio is 0.15 to 0.35 (preferred value 0.24). Boilup in the oxygen exchange column is provided by indirect heat exchange with a gaseous nitrogen stream from the HP column. Vapor exiting the top of the oxygen exchange column is recycled to the low pressure column. A liquid product that is concentrated in krypton and xenon is withdrawn from the bottom of the oxygen exchange column.

U.S. Pat. No. 4,401,448 reports results from a computer simulation of the process described above. The liquid product stream withdrawn from the oxygen exchange column contained 1.0% oxygen, 11000 ppm krypton, 900 ppm xenon, and 3200 ppm hydrocarbons with balance being nitrogen. This scheme alleviated two problems associated with prior processes. First, introduction of nitrogen at the bottom of the oxygen exchange column effectively displaces oxygen such that the product stream withdrawn from this column does not contain enough oxygen to form a flammable mixture with hydrocarbons. Second, the process is cryogenic. Krypton recovery was calculated as 72% from data presented in the patent and such a low recovery is undesirable.

SUMMARY OF THE INVENTION

The present invention is an improvement to a process for separating a feed gas containing krypton, xenon, oxygen and methane in a cryogenic distillation column. In the process, the feed gas is fed to an intermediate location of the distillation column for fractionation into a methane-free, krypton and xenon bottoms liquid and a methane-rich waste overhead. Liquid reflux for the column is provided by introducing a liquid feed to an upper location in the column above the intermediate feed location, and vapor reflux is provided to the column by introducing a gaseous bottom feed to an lower location in the column below the intermediate feed location. The improvement for increasing recovery of krypton and xenon and producing a krypton and xenon product containing less than 1 ppm methane comprises using a gaseous stream comprising at least 2% oxygen and less than 1 ppm methane as the gaseous bottom feed and operating the column so that the vapor to liquid flow ratio in the column is less than 0.15.

The preferable gaseous bottom feed is an oxygen-rich gas containing less than 1 ppm methane.

The process of the present invention can further provide additional vapor reflux to the column by boiling a portion of the methane-free, krypton and xenon bottoms liquid in a reboiler against a heat source.

DETAILED DESCRIPTION OF THE INVENTION

Figure 1:
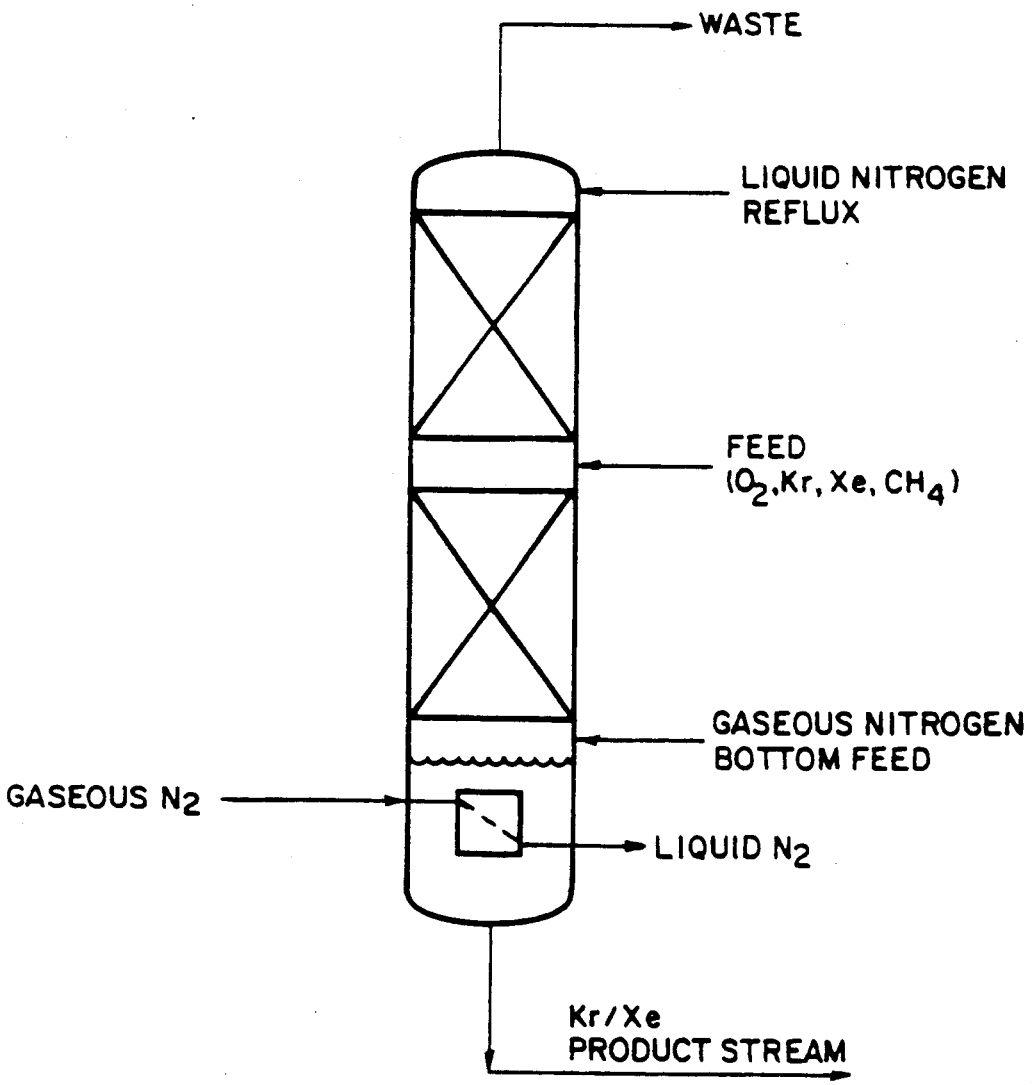
FIG. 1 PRIOR ART
FIG. 1 is a schematic diagram of the process of the prior art as taught in U.S. Pat. No. 4,647,299.

The present invention is a cryogenic distillation process that reduces the methane concentration in a krypton and xenon concentrate stream to below 1 ppm, a level comparable to that attainable using a methane burner. The cryogenic removal of methane would result in reduced capital, less cumbersome operation, and increased recovery of krypton and xenon as compared to the current method. These benefits are in addition to safety concerns.

The present invention is a process, which by the means of a distillation column and associated equipment, concentrates krypton and xenon while rejecting methane from a feed stream consisting primarily of less than 1 ppm of methane. Crude krypton column 51 operates at a reflux ratio below 0.15.

In the operation of the process of the present invention, it is preferential to have a high concentration of oxygen in the bottom gaseous feed stream, in line 53, in order to result in a high concentration of oxygen in the liquid bottoms of crude krypton column 51. The bottoms liquid will be comprised primarily of oxygen, argon, and nitrogen (determined by the compositions of streams 52 and 53) with small amounts of krypton and xenon.

Figure 2:
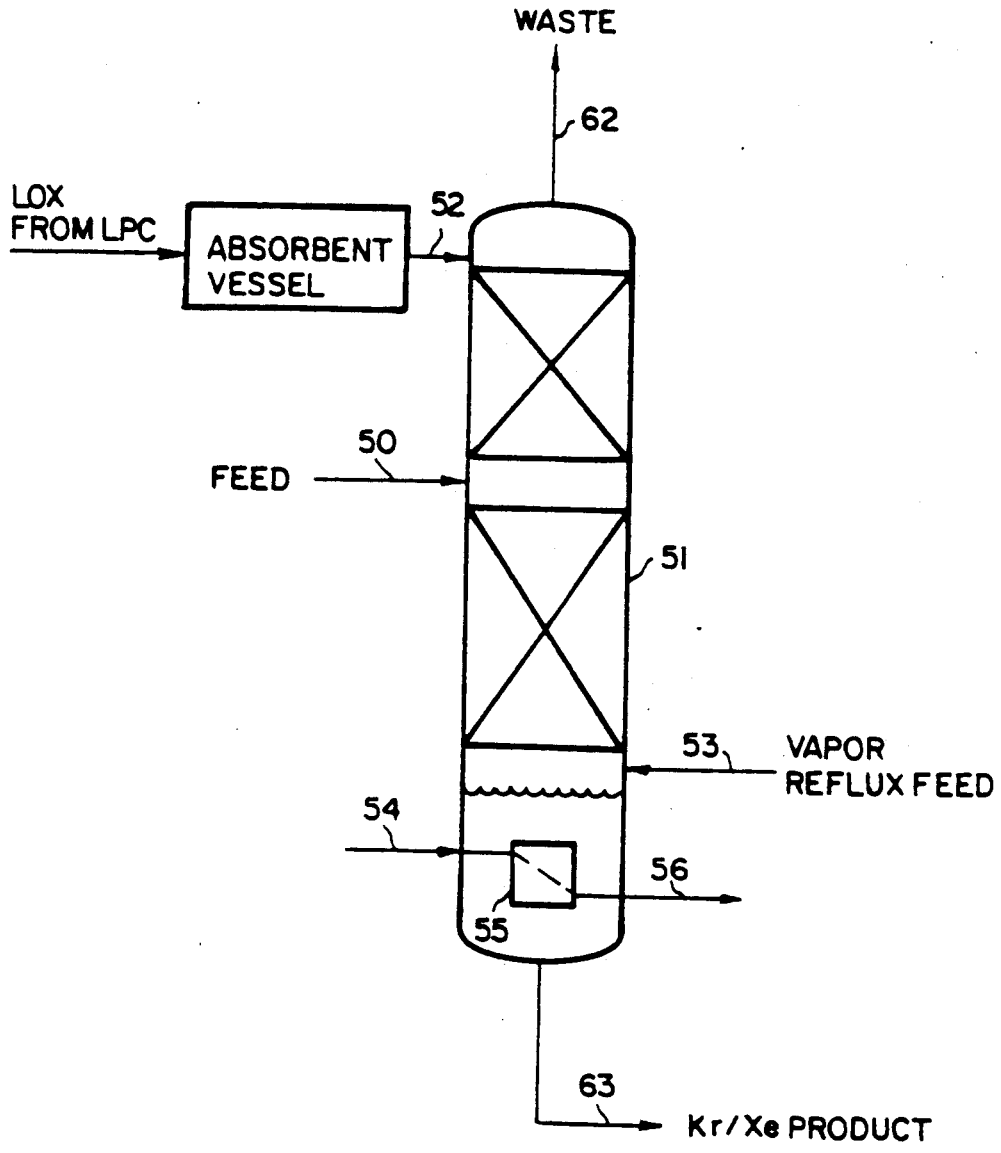
FIG. 2 is a schematic diagram of the process of the present invention.

FIG. 2 shows reboiler 55 at the bottom of the crude krypton column 51, however, it is not essential to use one. Oxygen-rich gaseous feed stream, in line 53, can be at any suitable temperature, for example it can be at its dew point or slightly superheated in a heat exchanger by heat exchange with an appropriate stream. Examples of such appropriate streams are crude liquid oxygen from the bottom of a high pressure column of a double column distillation system, a portion of the cold feed air stream from the main heat exchanger etc. Generally, the amount of superheat required is only a couple of degrees above the dew point temperature of the stream and usually this difference is less than 75°F.

When the oxygen-rich stream, in line 53, is either superheated or a reboiler is used in the bottom of the crude krypton column 51, the affect is that the concentration of krypton and xenon in the liquid product, removed in line 63, is much higher. It does not significantly influence the concentration of methane in the liquid product stream. Thus, an oxygen-rich gaseous feed stream, in line 53, at its dew point is as effective in removing methane as a corresponding slightly superheated stream.

As stated earlier, the purpose of the oxygen-rich stream, in line 53, is to drive methane from the feed liquid stream 50 into the vapor phase and out of the column in the overhead stream, in line 62. This can be better achieved by slightly increasing the temperature near the bottom of the crude krypton column. This is most easily accomplished by increasing the oxygen content of the stream 53. Therefore the higher the oxygen concentration in stream 53, the higher the oxygen concentration in the sump liquid, and the easier the separation of the krypton and xenon from oxygen. A schematic diagram of the process of the present invention is illustrated in FIG. 2. Operation of this column as discussed later will result in a product stream that is concentrated in krypton and xenon and that contains less than 1 ppm methane.

With reference to FIG. 2, a liquid feed stream containing oxygen, krypton, xenon, and methane is fed, via line 50, to an intermediate point of crude krypton column 51 for distillation thereby producing a waste overhead and a krypton/xenon bottoms product.

To provide liquid reflux to crude krypton column 51, a liquid stream is introduced at a location above the intermediate feed, via line 52, into column 51. Examples of liquid streams suitable for introduction as liquid reflux in line 52 include, but are not limited to, liquid nitrogen produced in a standard double column air separation unit, crude liquid argon produced in an auxiliary argon column, or liquid oxygen from the low pressure column of an air separation that has been passed through an adsorbent vessel. This third option is the one shown in FIG. 2. The adsorbent removes hydrocarbons, with the exception of methane, and other high-boiling impurities, such as carbon dioxide, that break through the front-end adsorbers.

To provide vapor flow up crude krypton column 51, a bottom gaseous feed, containing oxygen and less than 1 ppm methane, is introduced to crude krypton column 51 at a location below said intermediate point, preferably a point below the bottom equilibrium stage and above the liquid sump. Examples of streams suitable for the gaseous bottom feed stream, include but are not limited to, a stream withdrawn at least one equilibrium stage above the bottom of the HP column, a stream withdrawn at least one equilibrium stage above the bottom of the auxiliary argon column, or an oxygen stream that is methane-free. Crude krypton column 51 operates on the principal of ascending vapor stripping descending liquid of methane, krypton, and xenon preferentially in that order such that the waste overhead, removed via line 62, contains virtually all of the methane that entered in the feed and is also essentially krypton and xenon-free, whereas liquid bottoms product, removed via line 63, is concentrated in krypton and xenon and contains less than 5 ppm of methane and preferably methane in crude krypton column 51. A bottom feed 53, composed of oxygen, required approximately 30% of the flow and 30% of the duty in reboiler 55, when compared to using nitrogen as bottom feed 53, to achieve a given separation in crude krypton column 51.

The cited prior art was concerned with eliminating the safety risk associated with oxygen-methane mixtures by removing oxygen from the liquid product stream {analogous to stream 63}and replacing it with either argon or nitrogen. This was done since the liquid product streams contained appreciable amounts of methane. The current process described herein, removes essentially all the methane that enters in feed 50 in distillate 62, such that the concentration of methane in the liquid sump of crude krypton column 51 is less than 1 ppm, a concentration that is not a safety hazard. The use of oxygen in bottom feed 53 {and hence in the liquid sump of crude krypton column 51}is preferable as it will result in capital savings due to the reduced size of crude krypton column 51.

Conventional processes for the purification of the krypton and xenon from an air separation plant concentrate methane, as well as krypton and xenon, in an oxygen product stream. The concentration of methane in oxygen must be limited as these two compounds form an explosive mixture if concentration of methane builds up. The limit on methane concentration also limits the extent to which krypton and xenon can be concentrated in the product stream. The invention solves the problem and alleviates safety concerns associated with oxygen/methane mixtures by removing methane from the process by cryogenic distillation such that the product stream contains less than 1 ppm methane.

The process of the present invention works by taking advantage of the different relative volatilities of xenon, krypton, and methane. The boiling point of xenon is higher than that of krypton which is higher than that of methane. Therefore, for a vapor-liquid mixture at equilibrium at a given temperature (such a mixture exists on each tray of a distillation column) there will be a partitioning of xenon, krypton, and methane into both the vapor and liquid phases, with this partitioning governed by the relative volatilities. A larger percentage of the total xenon will be found in the liquid phase as compared to krypton and methane whereas a larger percentage of the total methane will be found in the vapor phase as compared to krypton and xenon.

Crude krypton column 51 has two sections; a section above intermediate feed 50 (upper section) and a section below intermediate feed 50 (lower section). Both sections operate at a liquid to vapor flow ratio (L/V ratio) below 0.15 with the upper section operating at a lower L/V ratio than the lower section. Vapor in the lower section of the column strips methane, krypton, and xenon (preferentially in that order) from the liquid in the lower section. The use of oxygen in bottom feed 53 is preferential to nitrogen as this results in a lower required vapor flow, as demonstrated.

The upper section operates on the same principle as the lower section. Since the reflux liquid 52 is free of krypton and Xe, the descending liquid removes krypton and xenon from the ascending vapor. The object in this section is to adjust the L/V ratio such that distillate 62 contains no krypton or xenon and all the methane that entered with intermediate feed 50. Computer simulations revealed that it is possible to operate the column to achieve this desired result by operating with a L/V ratio below 0.15.

The process of the present invention is of value as it results in the elimination of the methane burner that is required in current processes resulting in capital savings. Removal of the methane burner may also entail operating advantages as the invention utilizes a totally cryogenic process whereas the methane burner operates in the vicinity of 8OO-°1000° F.

EXAMPLES

In order to show the efficacy of the process of the present invention, computer simulations of the process were run using two different feed compositions for the bottom gaseous feed in line 53 and also varying the operation of the column with the use of reboiler 55. The results of these computer simulations are shown in Table I-IV.

TABLE I

| 95% Nitrogen/5% Oxygen Bottom Feed 53 | | | | | |
|---|---|---|---|---|---|
| Stream No. | 50 | 52 | 53 | 62 | 63 |
| Flow: mol/hr | 1.00 | 1.25 | 42.5 | 44.5 | 0.25 |
| Pressure: psia | 23.4 | 23.1 | 25.0 | 22.8 | 25.2 |
| Temperature: °F. | −288.6 | −289.2 | −309.7 | −309.5 | −308.3 |
| Composition | | | | | |
| $O_2$: % | 98.2 | 99.93 | 5.0 | 9.7 | 16.5 |
| $N_2$: % | — | — | 95.0 | 90.3 | 77.7 |
| Ar: ppm | 127 | 400 | — | 12.8 | — |

TABLE I-continued

| 95% Nitrogen/5% Oxygen Bottom Feed 53 | | | | | |
|---|---|---|---|---|---|
| Stream No. | 50 | 52 | 53 | 62 | 63 |
| Kr: ppm | 13273 | 27.1 | — | 1.8 | 52900 |
| Xe: ppm | 1024 | 2.05 | — | — | 4106 |
| $CH_4$: ppm | 3958 | 238.1 | — | 95.6 | 0.1 |

TABLE II

| Methane-Free Oxygen as Bottom Feed 53 | | | | | |
|---|---|---|---|---|---|
| Stream No. | 50 | 52 | 53 | 62 | 63 |
| Flow: mol/hr | 1.00 | 1.25 | 10.5 | 12.5 | 0.25 |
| Pressure: psia | 23.4 | 23.1 | 25.0 | 22.75 | 25.2 |
| Temperature: °F. | −288.6 | −289.2 | −287.6 | −289.4 | −286.3 |
| Composition | | | | | |
| $O_2$: % | 98.2 | 99.93 | 99.7 | 99.7 | 94.1 |
| $N_2$: % | — | — | — | — | — |
| Ar: ppm | 127 | 400 | 3000 | 2530 | 1775 |
| Kr: ppm | 13273 | 27.1 | — | 3.3 | 53061 |
| Xe: ppm | 1024 | 2.05 | — | — | 4106 |
| $CH_4$: ppm | 3958 | 238.1 | — | 340 | 0.1 |

TABLE III

| No Reboiler: Bottom Vapor Feed 53 at Dew Point | | | | | |
|---|---|---|---|---|---|
| Stream No. | 50 | 52 | 53 | 62 | 63 |
| Flow: mol/hr | 1.0 | 1.25 | 42.5 | 42.1 | 2.64 |
| Pressure: psia | 23.4 | 23.1 | 25.0 | 22.8 | 25.2 |
| Temperature: °F. | −288.6 | −289.2 | −309.7 | −309.6 | −309.5 |
| Composition | | | | | |
| $O_2$, % | 98.1 | 99.93 | 5.0 | 9.39 | 15.2 |
| $N_2$, % | — | — | 95.0 | 90.6 | 84.3 |
| Ar, ppm | 143 | 400 | — | 15 | — |
| Kr, ppm | 13668 | 27.1 | — | 1.2 | 5163 |
| Xe, ppm | 1112 | 2.05 | — | — | 421.3 |
| $CH_4$, ppm | 3978 | 238.1 | — | 101.5 | 0.2 |

TABLE IV

| No Reboiler: Superheated Bottom Gaseous Feed 53 | | | | | |
|---|---|---|---|---|---|
| Stream No. | 50 | 52 | 53 | 62 | 63 |
| Flow: mol/hr | 1.0 | 1.25 | 42.5 | 44.56 | 0.19 |
| Pressure: psia | 23.4 | 23.1 | 25.0 | 22.8 | 25.2 |
| Temperature: °F. | −288.6 | −289.2 | −291.7* | −309.5 | −308.0 |
| Composition | | | | | |
| $O_2$: % | 98.1 | 99.93 | 5.0 | 9.7 | 16.4 |
| $N_2$: % | — | — | 95.0 | 90.3 | 75.9 |
| Ar: ppm | 143 | 400 | — | 14 | — |
| Kr: ppm | 13668 | 27.1 | — | 1.9 | 70676 |
| Xe: ppm | 1112 | 2.05 | — | — | 5783 |
| $CH_4$: ppm | 3978 | 238.1 | — | 96.0 | 0.1 |

*Superheated by 18° F. over dew point

A comparison of the data shown Table I (wherein the composition of bottom feed 53 is 95% nitrogen/5% oxygen) and Table II (wherein the composition of bottom feed is 99.7% oxygen) shows a beneficial effect of increased oxygen in this stream. Both are capable of producing liquid product stream 63 with high concentrations of krypton and Xe; and containing 0.1 ppm methane. However, the flowrate of stream 53 in Table I (with 95% nitrogen) is about four times of the the flowrate of the same stream in Table II. Surely, the demonstration of the beneficial effect of increasing 02 content in stream 53.

Table III presents results for operation of the crude krypton column without a reboiler. Stream numbers correspond to those in FIG. 2. In this case, the feed to the bottom of the crude krypton column is a 95% nitrogen/5% 02 vapor stream at its dew point. Methane concentration in liquid product stream 63 is reduced to 0.2 ppm, comparable to the level obtained using a reboiler. The concentrations of krypton and xenon in product stream 63 are 5163 ppm and 421.3 ppm respectively. Both concentrations are approximately 10% of the concentrations obtained when a reboiler is used.

A method for increasing the concentrations of krypton and xenon in liquid product stream 63 is to introduce bottom feed 53 as a vapor superheated above its dew point. Results are presented in Table IV for operation of the crude krypton column without a reboiler in which bottom feed 53 is a 95% nitrogen/5% 02 stream superheated by 18° F. above its dew point. In this case, the concentrations of krypton, xenon and methane in liquid product stream 63 are 70676 ppm, 5783 ppm, and 0.1 ppm respectively. These concentrations are all comparable to those obtained when a reboiler is employed in the crude krypton column (compare stream 63 in Table I to stream 63 in Table IV). However, this technique saves the use of an additional heat exchanger.

Figure 3:
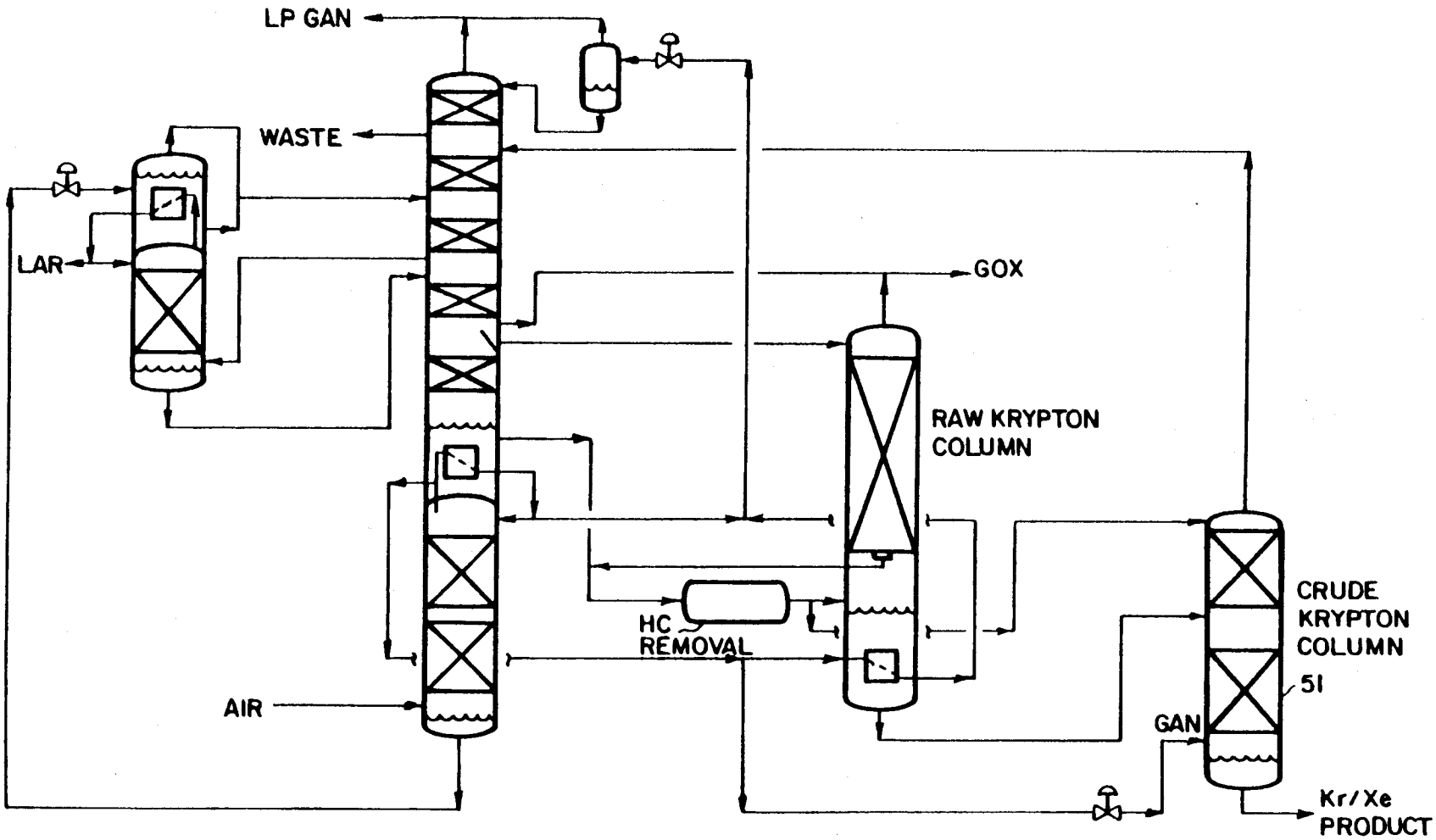
FIG. 3 is a schematic diagram of an air separation unit which incorporates the process of the present invention.
Figure 4:
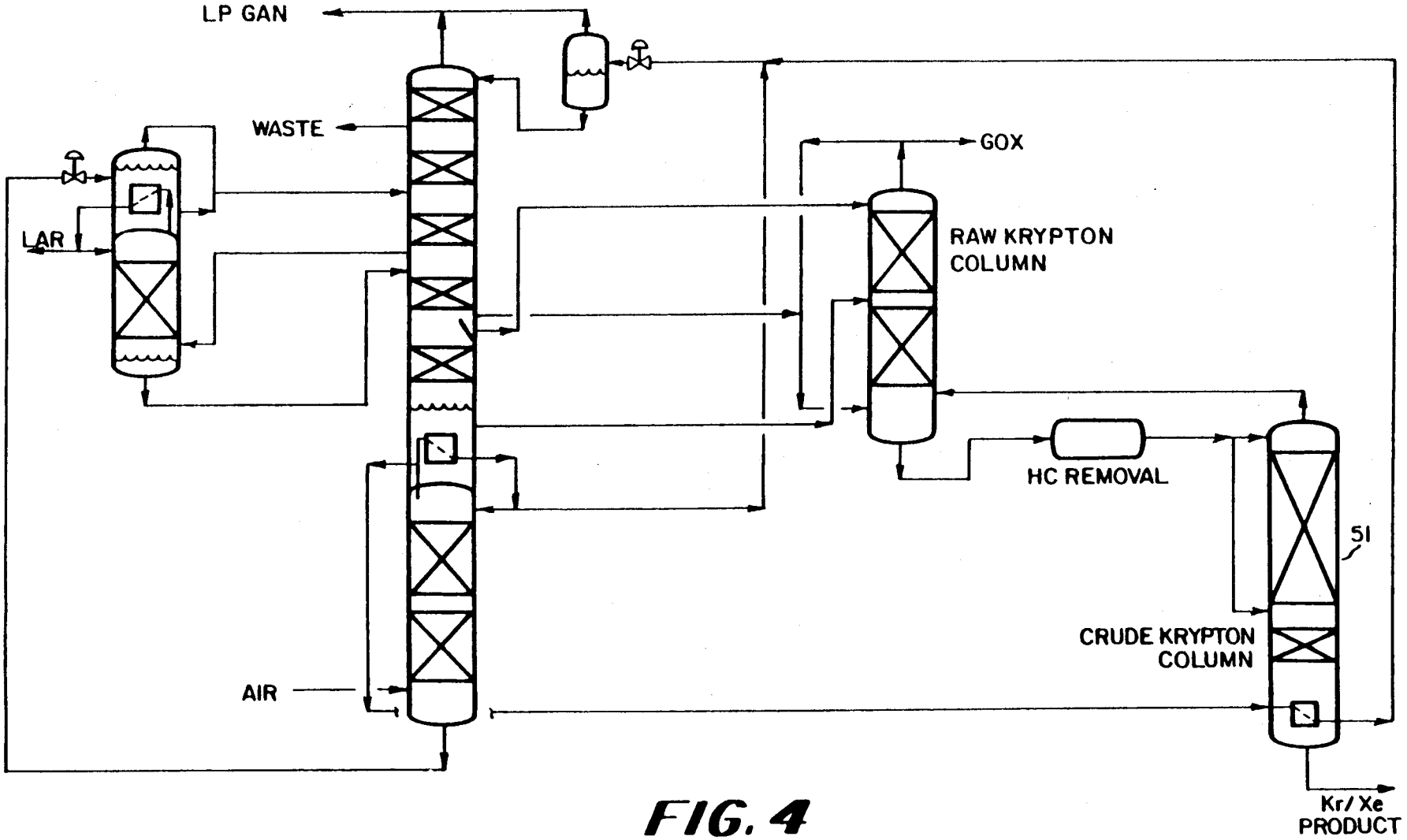
FIG. 4 is a schematic diagram of an alternate embodiment of an air separation unit which incorporates the process of the present invention.

The current invention can be integrated with the main air separation unit as shown in FIG. 3 and 4. These figures represent just two of the numerous ways in which the integration can be achieved.

A preferred method of integration is depicted in FIG. 3. The raw krypton column is refluxed with liquid withdrawn from above the sump of the low pressure column of the main air separation unit. Feed to the raw krypton column is provided by liquid oxygen withdrawn from the sump of the low pressure column. Reboiling duty in the raw krypton column is provided by gaseous nitrogen from the high pressure column of the main air separation unit. The gaseous nitrogen is condensed to liquid nitrogen in the reboiler at the bottom of the raw krypton column. A first portion of this liquid nitrogen is returned to the main air separation unit and a second portion is fed as reflux liquid to the top of the crude krypton column. As stated previously, liquid nitrogen is one of several liquids suitable for refluxing the crude krypton column. A portion of the liquid oxygen stream exiting the hydrocarbon adsorber can also be used as this reflux liquid. The krypton/xenon concentrate stream withdrawn from the bottom of the raw krypton column serves as feed for the crude krypton column. Stripping vapor in the crude krypton column is derived from an impure gaseous nitrogen stream withdrawn from an intermediate location from the high pressure column of the main air separation unit. Vapor exiting the top of the crude krypton column is recycled to the low pressure column of the main air separation unit. Methane-free krypton/xenon product is collected from the bottom of the crude krypton column.

One alternate method of integration is shown in FIG. 4. The raw krypton column is refluxed with liquid withdrawn from above the sump of the low pressure column of the main air separation unit. Liquid oxygen withdrawn from the sump of the low pressure column of the main air separation unit is fed at an intermediate point to the raw krypton column. A portion of a GOX stream withdrawn from above the sump of the low pressure column of the main air separation unit is fed to the bottom of the raw krypton column as stripping vapor. An optional second portion of this GOX stream is added to the vapor exiting the top of the raw krypton column and recovered as GOX product. Vapor in the raw krypton column strips methane from the liquid such that the product recovered from the bottom of the column contains a fraction of the methane that entered the column with the feed. This bottom product stream is passed through a hydrocarbon adsorber (methane is not removed in this step) and then fed to the crude krypton column. A portion of the feed is fed to the top of the crude krypton column, thereby providing reflux. A second portion of the feed is fed at an intermediate point to the column. This second portion may also be fed at a point just above the reboiling zone and just below the first equilibrium stage. Column vapor is provided by the reboiler at the bottom of the column and duty for this reboiler is provided by any appropriate process stream, such as gaseous nitrogen from the high pressure column of the main air separation unit. Nitrogen condensed in the reboiler is returned to an appropriate location in the main air separation unit. Vapor in the crude krypton column strips liquid of methane such that the krypton/xenon product recovered from the bottom of the column contains very low methane. Vapor from the top of the crude krypton column is fed to the bottom of the raw krypton column to provide additional vapor in the raw krypton column. The crude krypton column can also be operated in an alternate manner in which the feed liquid is not split and all of the feed liquid is fed at the top of the column.

The present invention has been described in reference to several specific embodiments thereof. These embodiments should not be viewed as limitations of the scope of the present invention. The scope of the present invention should be ascertained by the following claims.

We claim:

1. In a process for separating a feed gas containing krypton, xenon, oxygen and methane in a cryogenic distillation column wherein the feed gas is fed to an intermediate location of the distillation column for fractionation into a methane-free, krypton and xenon bottoms liquid and a methane-rich waste overhead, wherein liquid reflux for the column is provided by introducing a liquid feed to an upper location in the column above the intermediate feed location, and wherein vapor reflux is provided to the column by introducing a gaseous bottom feed to an lower location in the column below the intermediate feed location, the improvement for increasing recovery of krypton and xenon and producing a krypton and xenon product containing less than 1 ppm methane comprises using a gaseous stream containing at least 2% oxygen and less than 1 ppm methane as the gaseous bottom feed and operating the column so that the vapor to liquid flow ratio in the column is less than 0.15.

2. The process of claim 1, wherein the gaseous stream is an oxygen-rich gas containing less than 1 ppm methane.

3. The process of claim 1, wherein additional vapor reflux to the column is provided by boiling a portion of the methane-free, krypton and xenon bottoms liquid in a reboiler against a heat source.

* * * * *